US010206027B2

(12) United States Patent
Timothy et al.

(10) Patent No.: US 10,206,027 B2
(45) Date of Patent: Feb. 12, 2019

(54) SPEAKERS AND HEADPHONES RELATED TO VIBRATIONS IN AN AUDIO SYSTEM, AND METHODS FOR OPERATING SAME

(71) Applicant: Skullcandy, Inc., Park City, UT (US)

(72) Inventors: John Timothy, Salt Lake City, UT (US); Sam Noertker, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 15/589,565

(22) Filed: May 8, 2017

(65) Prior Publication Data

US 2017/0245042 A1 Aug. 24, 2017

Related U.S. Application Data

(63) Continuation of application No. 14/616,639, filed on Feb. 6, 2015, now Pat. No. 9,648,412.

(51) Int. Cl.
*H04R 1/24* (2006.01)
*H04R 1/26* (2006.01)
(Continued)

(52) U.S. Cl.
CPC ..... *H04R 1/24* (2013.01); *H04R 1/1008* (2013.01); *H04R 1/1041* (2013.01);
(Continued)

(58) Field of Classification Search
CPC . H04R 1/005; H04R 1/24; H04R 1/26; H04R 1/1091; H04R 3/12; H04R 3/14;
(Continued)

(56) References Cited

U.S. PATENT DOCUMENTS 4,001,658 A 1/1977 Helmuth
7,187,948 B2 3/2007 Alden
(Continued)

FOREIGN PATENT DOCUMENTS

CA 2697029 2/2007
CA 2515558 6/2010
(Continued)

OTHER PUBLICATIONS

European Search Report and Search Opinion from European Application No. EP16154300 dated Jun. 23, 2016, 9 pages.
(Continued)

*Primary Examiner* — Joshua Kaufman
(74) *Attorney, Agent, or Firm* — TraskBritt

(57) ABSTRACT

A speaker assembly includes a support structure and a tactile vibrator coupled to the support structure. The tactile vibrator includes a plurality of rigid members coupled to a plurality of suspension members. Each rigid member of the plurality of rigid members has at least one magnetic member coupled thereto for generating tactile vibrations during operation of the speaker assembly. A headphone includes the speaker assembly. A method of operating a speaker assembly includes driving a tactile vibrator having a plurality of magnetic members coupled to a plurality of rigid members and a plurality of suspension members to cause tactile vibrations in the speaker assembly.

20 Claims, 10 Drawing Sheets

(51) Int. Cl.

| | |
|---|---|
| ***H04R 9/02*** | (2006.01) |
| ***H04R 9/06*** | (2006.01) |
| ***H04R 1/10*** | (2006.01) |
| ***H04R 11/14*** | (2006.01) |
| *H04R 9/18* | (2006.01) |
| *H04R 31/00* | (2006.01) |

(52) U.S. Cl.
CPC ..... *H04R 1/1091* (2013.01); *H04R 1/26* (2013.01); *H04R 9/025* (2013.01); *H04R 9/063* (2013.01); *H04R 11/14* (2013.01); *H04R 1/1075* (2013.01); *H04R 9/18* (2013.01); *H04R 31/006* (2013.01); *H04R 2205/022* (2013.01); *H04R 2400/03* (2013.01); *H04R 2400/07* (2013.01); *H04R 2460/13* (2013.01)

(58) Field of Classification Search
CPC . H04R 9/02; H04R 9/025; H04R 9/06; H04R 9/063; H04R 9/066; H04R 9/18; H04R 31/006; H04R 2205/022; H04R 2400/03; H04R 2400/07; H04R 2460/13
See application file for complete search history.

(56) References Cited

U.S. PATENT DOCUMENTS

| | | | | |
|---|---|---|---|---|
| 7,395,090 | B2 | 7/2008 | Alden | |
| D623,627 | S | 9/2010 | Alden et al. | |
| D624,057 | S | 9/2010 | Kelly et al. | |
| D641,003 | S | 7/2011 | Alden | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| 8,457,557 | B2 | 6/2013 | Alden | |
| D685,759 | S | 7/2013 | Kelly et al. | |
| D685,767 | S | 7/2013 | Kelly et al. | |
| 8,515,115 | B2 | 8/2013 | Kelly et al. | |
| D689,464 | S | 9/2013 | Bonahoom et al. | |
| 8,542,859 | B2 | 9/2013 | Alden | |
| D691,582 | S | 10/2013 | Nguyen et al. | |
| D693,793 | S | 11/2013 | Kelly et al. | |
| 8,594,362 | B2 | 11/2013 | Liu | |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| D707,654 | S | 6/2014 | Nguyen et al. | |
| 9,430,921 | B2 | 8/2016 | Biggs | |
| 2002/0027999 | A1* | 3/2002 | Azima | B42D 15/022 381/431 |
| 2003/0007653 | A1* | 1/2003 | Azima | H04R 1/24 381/152 |
| 2007/0142025 | A1 | 6/2007 | Alden | |
| 2008/0267440 | A1 | 10/2008 | Alden | |
| 2011/0075880 | A1 | 3/2011 | Kamimura et al. | |
| 2011/0127858 | A1 | 6/2011 | Park | |
| 2011/0164776 | A1 | 7/2011 | Kelly et al. | |
| 2011/0235819 | A1 | 9/2011 | Alden | |
| 2012/0008816 | A1* | 1/2012 | Liu | H04R 9/063 381/401 |
| 2012/0128172 | A1 | 5/2012 | Alden | |
| 2012/0275615 | A1 | 11/2012 | Kelly et al. | |
| 2012/0280592 | A1 | 11/2012 | Penn | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mulder | |
| 2013/0336514 | A1 | 12/2013 | Kelly et al. | |
| 2014/0012070 | A1 | 1/2014 | Nagl | |
| 2014/0056459 | A1 | 2/2014 | Oishi et al. | |
| 2014/0056463 | A1 | 2/2014 | Kim et al. | |
| 2014/0211959 | A1 | 7/2014 | Boyajian et al. | |
| 2014/0270228 | A1 | 9/2014 | Oishi et al. | |
| 2014/0270230 | A1 | 9/2014 | Oishi et al. | |
| 2014/0341420 | A1 | 11/2014 | Karkkainen et al. | |
| 2015/0189441 | A1 | 7/2015 | Oishi et al. | |
| 2016/0234588 | A1 | 8/2016 | Timothy et al. | |
| 2016/0269827 | A1 | 9/2016 | Casset | |

FOREIGN PATENT DOCUMENTS

| | | | | |
|---|---|---|---|---|
| CA | 153644 | | 7/2014 | |
| EP | 1760896 | | 9/2010 | |
| EP | 2262117 | | 12/2010 | |
| EP | 2701400 | A2 | 2/2014 | |
| WO | 0046786 | A2 | 8/2000 | |
| WO | WO 0046786 | A2 * | 8/2000 | H04R 5/033 |
| WO | 2007121380 | A2 | 10/2007 | |
| WO | 2010068495 | | 6/2010 | |
| WO | 2010124190 | | 10/2010 | |
| WO | 2011085096 | | 7/2011 | |
| WO | 2012024656 | | 2/2012 | |
| WO | 2012173669 | A2 | 12/2012 | |
| WO | 2015012303 | A1 | 1/2015 | |

OTHER PUBLICATIONS

Inman, Daniel J., More than Two Degrees of Freedom, Engineering Vibration, Third Edition, Chapter 4, Nov. 12, 2011, pp. 303-329.

Noertker et al., U.S. Appl. No. 62/098,936, entitled, Methods of Generating Tactile User Feedback Utilizing Headphone Devices and Related Systems, filed Dec. 31, 2014.

Russell, Daniel A., "Multiple Degree-of-Freedom Mass-Spring Systems", Retrieved from the Internet: URL:http://www.acs.psu.edu/drussell/Demos/multi-dof-springs/multi-dof-springs.html, Sep. 7, 2012, 2 pages.

Chinese Office Action for Chinese Application No. 2016100770176 dated May 30, 2018, 21 pages.

* cited by examiner

SPEAKERS AND HEADPHONES RELATED TO VIBRATIONS IN AN AUDIO SYSTEM, AND METHODS FOR OPERATING SAME

CROSS-REFERENCE TO RELATED APPLICATION

This application is a continuation of U.S. patent application Ser. No. 14/616,639, filed Feb. 6, 2015, now U.S. Pat. No. 9,648,412, issued May 9, 2017, the disclosure of which is hereby incorporated herein in its entirety by this reference.

FIELD

The disclosure relates generally to speaker devices. More specifically, disclosed embodiments relate to speaker devices that include a speaker configured to generate tactile vibrations that may be sensed by a person using the speaker, to headphones including such speakers, and to methods of operating and using such speakers and headphones.

BACKGROUND

Conventional portable audio systems often include a headphone that is connected to a media player (e.g., by one or more wires or by wireless technology). Conventional headphones may include one or two speaker assemblies having an audio driver that produces audible sound waves with a diaphragm. For example, FIGS. 1 and 2 illustrate speaker assemblies 100 and 200, respectively, for a conventional headphone.

Referring to FIG. 1, the speaker assembly 100 may include a diaphragm 110 connected to a rim of a support structure 120, which may cause the outer edge of the diaphragm to be relatively rigid. In the center area of the diaphragm 110 is a rigid cone member coupled to a magnetic member (e.g., coil, magnet). The portion of the diaphragm 110 outside of the rigid cone member may include a suspension member that determines the stiffness of the diaphragm 110 that permits the magnetic member attached to the diaphragm 110 to move back and forth in a magnetic field responsive to an audio signal. As a result, the diaphragm 110 generates audible sound waves in the air proximate the speaker assembly 100 that correspond to the frequencies of the audio signals.

Conventionally, the diaphragm 110 includes a single suspension member coupled between two rigid members (e.g., the rim of the support structure 120 and the cone member). As a result, the speaker assembly 100 acts as a single mass/spring system having a single resonant frequency that is at least partially dependent on the mass of the rigid cone member and the spring constant of the flexible suspension member of the diaphragm 110. For example, some diaphragms may have a resonant frequency of approximately 90 Hz. The resonant frequency in such a configuration may be decreased by increasing the diameter of the diaphragm 110 and/or by reducing the thickness of the plastic material. It may, however, be difficult or impractical to form a diaphragm 110 having a conventional design that exhibits a lower resonant frequency, because the size of the diaphragm 110 would be too large, and/or the diaphragm 110 would be too thin and susceptible to damage.

Referring to FIG. 2, in additional previously known speaker systems, a speaker assembly 200 may include a metal suspension member 210 (instead of a plastic diaphragm) connected to a rim of a support structure 220. The suspension member 210 may be generally circular, and may have flexible beams connecting a radially outer rigid portion and a radially inner rigid portion. The inner rigid portion may be a platform to which a coil and a magnet may be attached. The speaker assembly 200 of FIG. 2 may also include a single suspension member 210 coupled between two rigid members (e.g., the rim of the support structure 220 and the cone member).

Speaker assemblies may also include tactile bass vibrators that are configured to generate tactile vibrations within the speaker assemblies that may be felt by the user. Tactile bass vibrators may also at least partially supplement the acoustic bass frequencies of the speaker assembly. Conventional tactile bass vibrators may include a single suspension member coupled between two rigid members, which result in a resonant frequency that is tuned to a desired bass frequency to achieve the desired effect; however, conventional tactile vibrators typically have a limited optimal frequency range of vibration amplitude (i.e., bass frequencies only).

DETAILED DESCRIPTION

Figure 1:
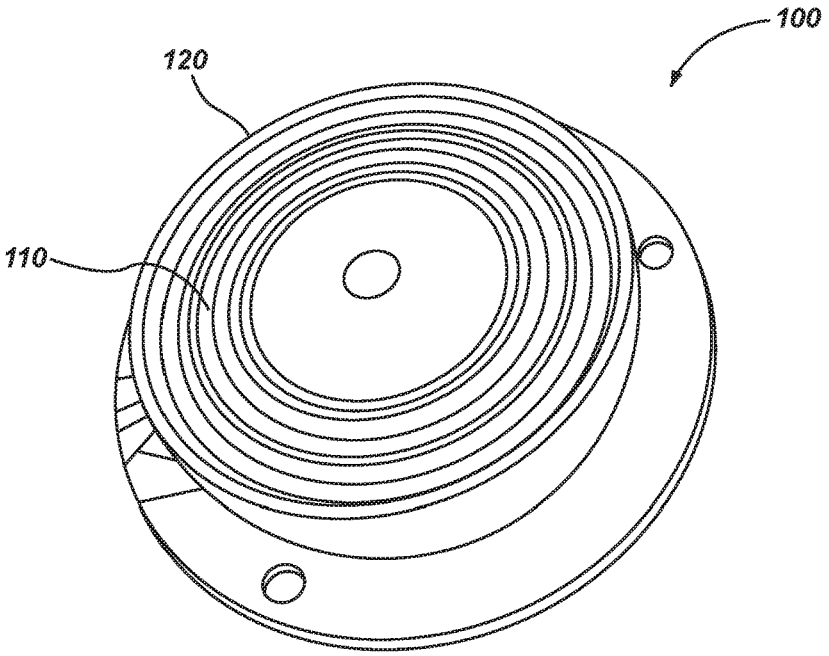
FIG. 1 illustrates a conventional speaker assembly for a headphone.
Figure 2:
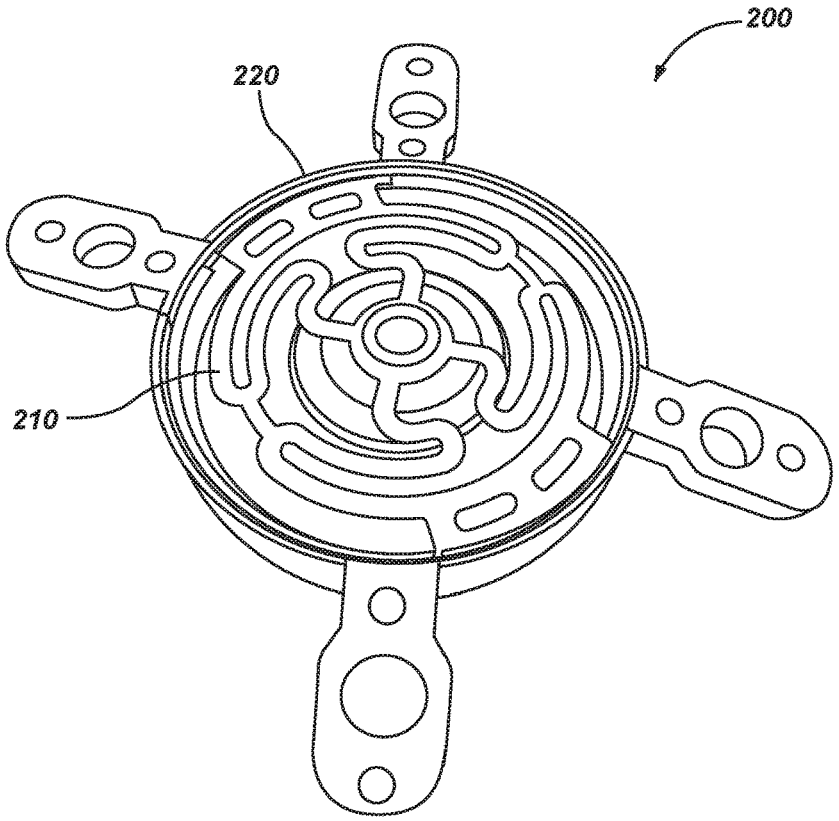
FIG. 2 illustrates another conventional speaker assembly for a headphone.

In the following description, reference is made to the accompanying drawings in which is shown, by way of illustration, specific embodiments of the present disclosure. The embodiments are intended to describe aspects of the disclosure in sufficient detail to enable those skilled in the art to practice the invention. Other embodiments may be utilized and changes may be made without departing from the scope of the disclosure.

Disclosed embodiments relate generally to speakers and headphones that are configured to generate tactile vibrations that may be felt by a person using the speakers and headphones. In particular, disclosed embodiments may include a speaker configured to vibrate responsive to an electronic audio signal. In some embodiments, the speaker may include a tactile vibrator that is configured as a multi-resonant system to generate vibrations. The speaker may include multiple voice coil/magnet and mass-spring systems, which may be independently driven to achieve different vibration responses. As a result, an overall wider range of vibration response may also be generated. By joining multiple mass-spring systems together, the frequency range over which vibrations of large amplitude may be generated is increased. The tactile vibrator includes multiple rigid members that are connected to each other through suspension members. The rigid members can either be passive or actively driven. In the active scenario, the respective rigid member may be actuated via a Lorentz force actuator typically consisting of a coil of wire and a magnet assembly as in a typical speaker. The actuator may include large concentric coils that surround the rigid member, or the rigid members may also be forced as a multi-actuator transducer in which multiple actuators are placed at different points along the rigid member to create the vibration. The frequency response of the tactile vibrator may change depending on which rigid members are driven actively or passively, which may add additional modes of controlling the vibration characteristics of the tactile vibrator.

A "speaker assembly" is as an acoustic device configured to contribute to the generation of sound waves, such as with the reproduction of speech, music, or other audible sound. Thus, a speaker assembly may include an audio driver configured to produce audible sound. A speaker assembly may also produce tactile vibrations that may be felt by a person. Thus, a speaker may include a tactile vibrator. A tactile vibrator may also be referred to as a transducer, a driver, a shaker, etc. Thus, an audio driver is configured primarily to emit audible sound frequencies, although some minor tactile vibrations may be generated by the audio driver in some embodiments. A tactile vibrator is configured primarily to generate tactile vibrations, although some low frequency audible sound may also be generated by the tactile vibrator 450 in some embodiments. While examples are given for speaker assemblies that are incorporated within headphones, incorporation within other devices is also contemplated.

A "magnetic member" may be a coil or a permanent magnet that is used to form a coil/magnet pair of a speaker assembly that are driven to move the rigid members back and forth relative to the support structure. In some configurations, a coil may be coupled to the tactile vibrator while a magnet is coupled to a support structure (e.g., ear cup), while in other embodiments, a magnet may be coupled to the tactile vibrator and a coil is coupled to the support structure.

A "bass frequency" is a relatively low audible frequency generally considered to be within the range extending from approximately 16 Hz to approximately 512 Hz. For purposes of this disclosure, a "low bass frequency" refers to bass frequencies that may be felt as well as heard. Such low bass frequencies may be within the range extending from approximately 16 Hz to approximately 200 Hz. A "midrange frequency" is generally considered to be within the range extending from 512 Hz to 2.6 kHz. An "upper midrange frequency" is generally considered to be within the range extending from 2.6 kHz to 5.2 kHz. A "high end frequency" is generally considered to be within the range extending from 5.2 kHz to 20 kHz.

As used herein, the term "rigid" refers to a member of a tactile vibrator that, for the forces applied in an acoustic driver, exhibits a suitable stiffness so that the entire rigid member moves together when being displaced as opposed to different regions deforming non-uniformly. For example, when viewing a cross-section of the tactile vibrator, the rigid member remains substantially parallel to the resting plane. A suspension member of the tactile vibrator may experience some oscillation with a force applied thereto during the intended operation of the tactile vibrator. The oscillation may include non-uniform deformation of the suspension member. For example, when viewing a cross-section of the tactile vibrator, the suspension member does not remain substantially parallel to the resting plane (i.e., is tilted relative to the resting plane).

Figure 3:
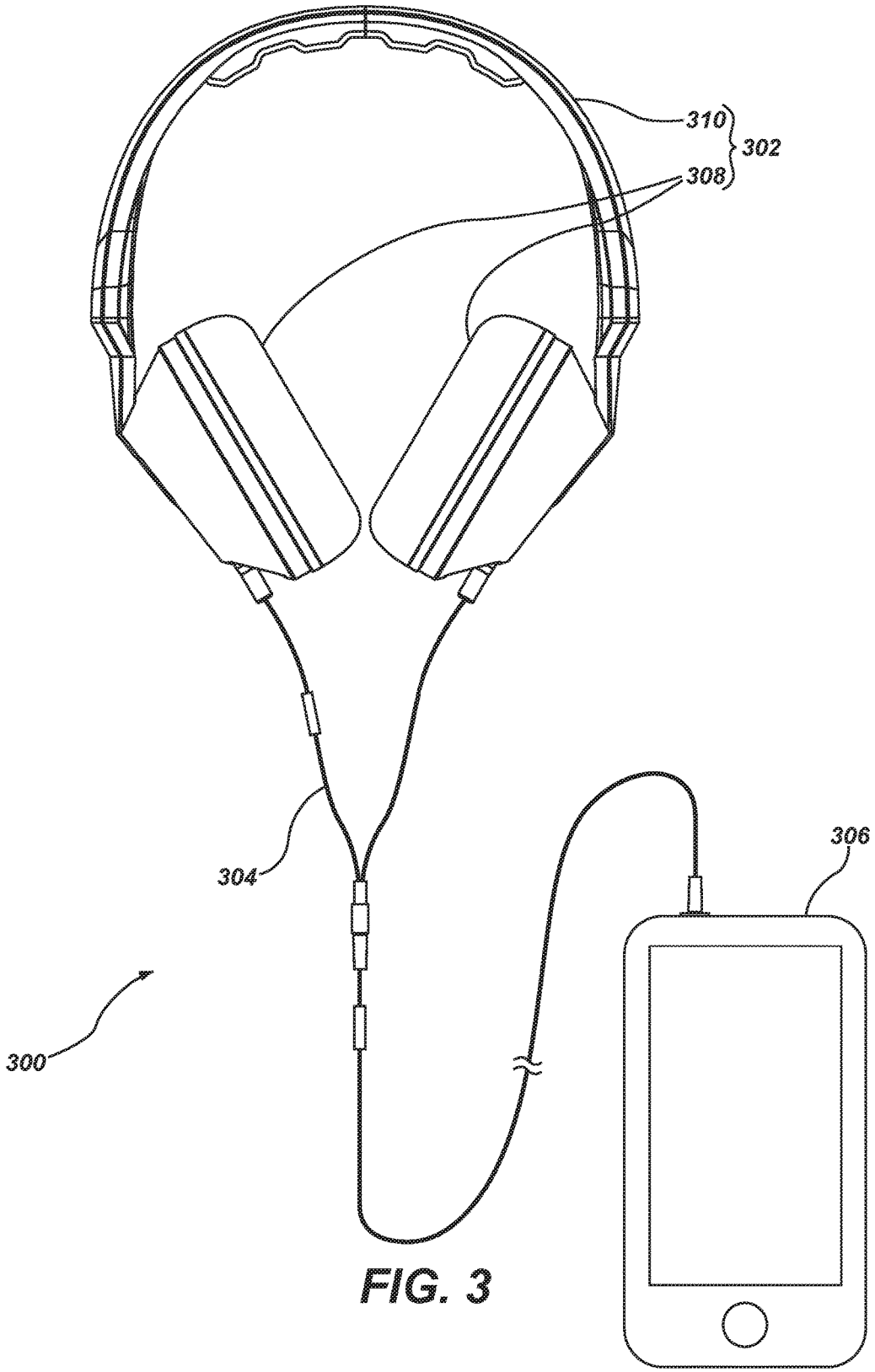
FIG. 3 is a simplified view of an embodiment of an audio system of the present disclosure.

FIG. 3 illustrates an audio system 300 of according to an embodiment of the present disclosure. The audio system 300 may include a headphone 302, a wiring system 304, and a media player 306. The headphone 302 and media player 306 may be connected to the wiring system 304 such that audio signals carried by the wiring system 304 are transmitted from the media player 306 to the headphone 302. Thus, an audio signal generated by the media player 306 may be transmitted through the wiring system 304 to the headphone 302 where the audio signal is converted to audible sound. In additional embodiments, the audio system 300 may wirelessly transmit the audio signal to the headphone 302.

The headphone 302 may comprise two speaker assemblies 308 and a headband 310. The headband 310 may be configured to rest on a user's head, and to support the two speaker assemblies 308 when in use. The headband 310 may also be configured to position the two speaker assemblies 308 attached to the headband 310 proximate (e.g., on or over) a user's ears such that sound from the speaker assemblies 308 is heard by the user. In yet further embodiments, the headphone 302 may comprise earbud speaker assemblies (which may or may not be carried on a headband 310), which may be inserted into the ears of the user.

The media player 306 may include any device or system capable of producing an audio signal and connectable to a speaker to convert the audio signal to audible sound. For example, the media player 306 may include smart phones or other phones, gaming systems, DVD players or other video players, laptop computers, tablet computers, desktop computers, stereo systems, microphones, personal digital assistants (PDAs), eBook readers, and music players such as digital music players, portable CD players, portable cassette players, etc. Other types of media players are also contemplated. As shown in FIG. 3, the media player 306 may comprise, for example, an IPHONE® commercially available from Apple of Cuppertino, Calif.

The speaker assemblies 308 may include an audio driver configured to convert the audio signal to audible sound and a tactile vibrator configured to generate a tactile response (e.g., vibrations), as described in further detail hereinbelow.

Figure 4:
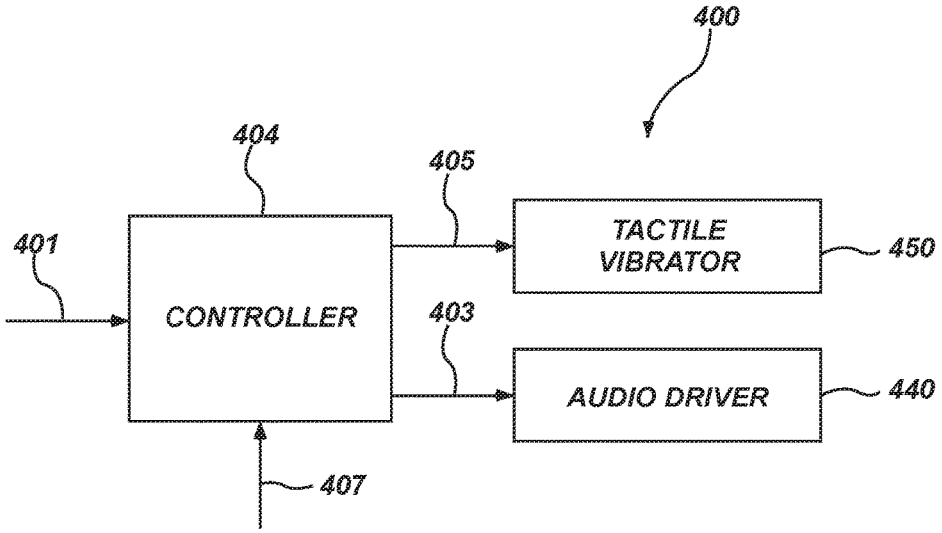
FIG. 4 is a simplified block diagram of a driver system according to an embodiment of the present disclosure.

FIG. 4 is a simplified block diagram of one driver system 400 according to an embodiment of the present disclosure. Such a driver system 400 may be included within each of the speaker assemblies 308 of FIG. 3 to convert an audio signal 401 to audible sound and a tactile response. The driver system 400 includes an audio driver 440 configured to emit sound at audible frequencies, and an additional, separate tactile vibrator 450 configured to generate tactile vibrations within the speaker assemblies 308 that may be felt by the user. As discussed above, the audio driver 440 is configured primarily to emit audible sound frequencies, although some minor tactile vibrations may be generated by the audio driver 440 in some embodiments. The tactile vibrator 450 is configured primarily to generate tactile vibrations, although some low frequency audible sound may also be generated by the tactile vibrator 450 in some embodiments.

The driver system 400 may include a controller 404 configured to receive an input audio signal 401 (e.g., from the media player 306 (FIG. 3)) and transmit a first audio signal 403 to the audio driver 440 and a second audio signal 405 to the tactile vibrator 450. In some embodiments, the controller 404 may include frequency filters (e.g., a low-pass frequency filter, a high-pass frequency filter, etc.) such that the first audio signal 403 includes medium to high frequencies (e.g., midrange, upper midrange, high end), while the second audio signal 405 includes the bass frequencies. In some embodiments, the first audio signal 403 may include at least some low frequencies, while the second audio signal 405 may include at least some medium to high frequencies. In addition, at least some of the frequencies of the first audio signal 403 and the second audio signal 405 may at least partially overlap. For example, the audio driver 440 may be configured to emit some bass frequencies that are further enhanced by the tactile vibrator 450. In addition, the audio driver 440 may be configured to emit medium or high frequencies that are further enhanced by the tactile vibrator 450. In some embodiments, the controller 404 may output the second audio signal 405 as different channels of audio signals in order to control the vibration of a tactile vibrator 450 having different rigid members. As a result, each rigid member may be independently controlled by its associated channel in order to achieve different vibration responses. Tactile vibrators having a plurality of rigid members and a plurality of suspension members will be described further herein with respect to FIGS. 7A through 9.

Referring still to FIG. 4, the controller 404 may further include control logic configured to modify the audio signals 403, 405 responsive to a control signal 407. For example, the control signal 407 may control characteristics, such as volume. The controller 404 may be configured to control the first audio signal 403 and the second audio signal 405 independently. For example, a user may desire louder bass frequencies and a stronger tactile response at the bass frequencies. As a result, more power may be supplied to the tactile vibrator 450 relative to the power supplied to the audio driver 440.

Figure 5:
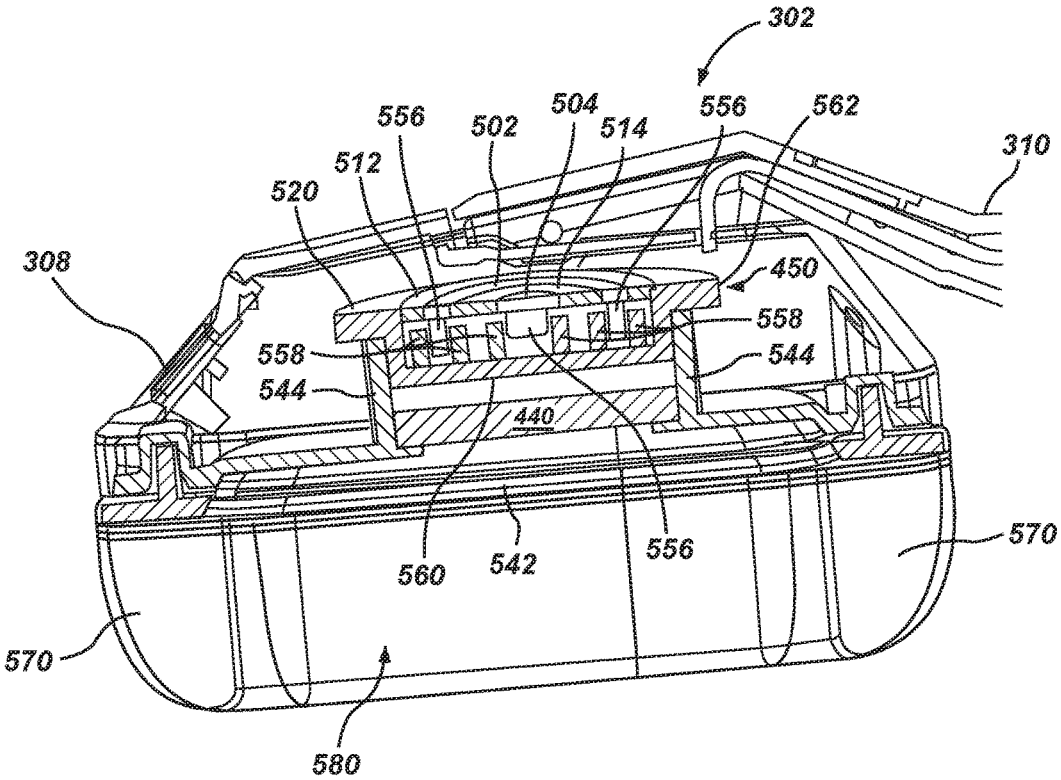
FIG. 5 is a cross-sectional side view of a portion of the headphone of FIG. 3.

FIG. 5 is a cross-sectional side view of a portion of the headphone 302 of FIG. 3. The headphone 302 may include the speaker assembly 308 connected to the headband 310. Although not shown in FIG. 5, the headphone 302 may include two such speaker assemblies 308 on opposing sides of the headband 310. The speaker assembly 308 may have an ear cup configured to rest on or over the ear of the user. The speaker assembly 308 may include an air cavity 580, and a cushion 570 for comfort when worn over the ear of the user. The speaker assembly 308 may further include the audio driver 440 configured to emit sound at audible frequencies, and an additional, separate tactile vibrator 450 configured to generate tactile vibrations within the speaker assembly 308 that may be felt by the user. In some embodiments, the speaker assembly 308 may further include a plate 542 positioned between the audio driver 440 and the air cavity 580. The tactile vibrator 450 may be located within a housing of the speaker assembly 308. In other embodiments, the tactile vibrator 450 may be located outside of the housing of the speaker assembly 308, such as being connected to an external surface of the speaker assembly 308.

The tactile vibrator 450 may include a plurality of rigid members 502, 504, and a plurality of suspension members 512, 514. The first rigid members 502 may be coupled to a support structure 520 via the first suspension member 512. The first rigid member 502 and the second rigid member 504 may be coupled together via the second suspension member 514. The rigid members 502, 504 may be configured for mounting one or more magnetic members 556 thereon. As shown in FIG. 5, the tactile vibrator 450 may include the rigid member 504 (e.g., inner platform portion) that has a middle magnetic member 556 (e.g., coil, permanent magnet) coupled thereto. For example, the middle magnetic member 556 may be attached to the underside of the rigid member 504 of the tactile vibrator 450. The outer magnetic members 556 may be attached to the underside of the rigid member 502. Further detail regarding different embodiments of the tactile vibrator 450 will be described below with reference to FIGS. 7A through 9. At least one rigid member of the tactile vibrator 450 may also have an additional optional weight (not shown) mounted thereon to increase the mass to achieve a desired resonant frequency.

The support structure 520 may further include a lower support structure 560 and a circumferentially extending rim 562. A radially outer portion of the first suspension member 512 may be connected to the circumferentially extending rim 562, such as by adhesive, a fastener, a snap fit, etc. In some embodiments, the first suspension member 512 may be integrally formed with the lower support structure 560. The tactile vibrator 450 may further include one or more additional magnetic members 558 (e.g., coils, magnets). The additional magnetic members 558 may be configured to generate a magnetic field responsive to an audio signal (e.g., second audio signal 405 (FIG. 4)). The additional magnetic members 558 may be coupled to the lower support structure 560 within a cavity between the lower support structure 560 and the suspension member of the tactile vibrator 450, such that the magnetic members 556 may be within the magnetic field generated by the additional magnetic members 558.

In some embodiments, the permanent magnet and coils may be reversed, such that permanent magnets may be coupled to the lower support structure 560 and one or more coils may be coupled to the rigid members 502, 504 of the tactile vibrator 450. In either embodiment, coils may receive the audio signal (e.g., second audio signal 405) and generate a magnetic field in response to the current flowing through the coils. The magnitude of the magnetic field may oscillate based, at least in part, on the frequency of the audio signal. The magnetic member 556 may respond to the changing magnetic field such that the suspension members 512, 514 enable the magnetic member 556 to be displaced relative to the resting plane. As a result, the tactile vibrations within the speaker assembly 308 are generated while the magnetic member 556 is displaced.

The tactile vibrator 450 may be oriented parallel with the plate 542. In other words, the vibrations of the tactile vibrator 450 may be at least substantially perpendicular to the plate 542. The vibrations caused from the displacement of the tactile vibrator 450 may cause the plate 542 to vibrate. While vibrating, the plate 542 may produce pressure waves in the air cavity 580, which may enhance the certain frequencies that are approximately near the resonant frequencies that are produced by the operation of the tactile vibrator 450. The pressure waves and other physical vibrations in the headphone 302 may also be felt as vibrations to the user, which may further enhance the user's listening experience. Some modifications to the headphone 302 may affect the feel of the vibrations generated by the bass. For example, the size of the air cavity 580 may affect the strength of the vibrations. Forming apertures in the plate 542 may also have a similar effect as increasing the size of the air cavity 580, as the effective size of the air cavity 580 would be increased.

As discussed above, FIG. 5 shows a single speaker assembly 308; however, it should be recognized that the headband 310 may be coupled to two such speaker assemblies 308 (i.e., one for each ear). In some embodiments, each pair of speaker assemblies 308 may be configured the same. For example, the resonant frequencies of each of the tactile vibrators 450 may be the same for the right speaker assembly as well as the left speaker assembly. In some embodiments, however, the speaker assemblies of a headphone may have different components therein. For example, one of the speaker assemblies may include a battery for providing power thereto. As a result, the added weight of the battery may affect the overall resonant frequency of the tactile base vibrator associated with that headphone. To compensate for such a difference in resonant frequencies, the tactile vibrator on one side of the headphone may be configured to exhibit resonant frequencies that are different than the tactile vibrator on the other side of the headphone. As a result, the overall effect of the resonant frequency for vibration of each of the speaker assemblies may be approximately the same.

Figure 6:
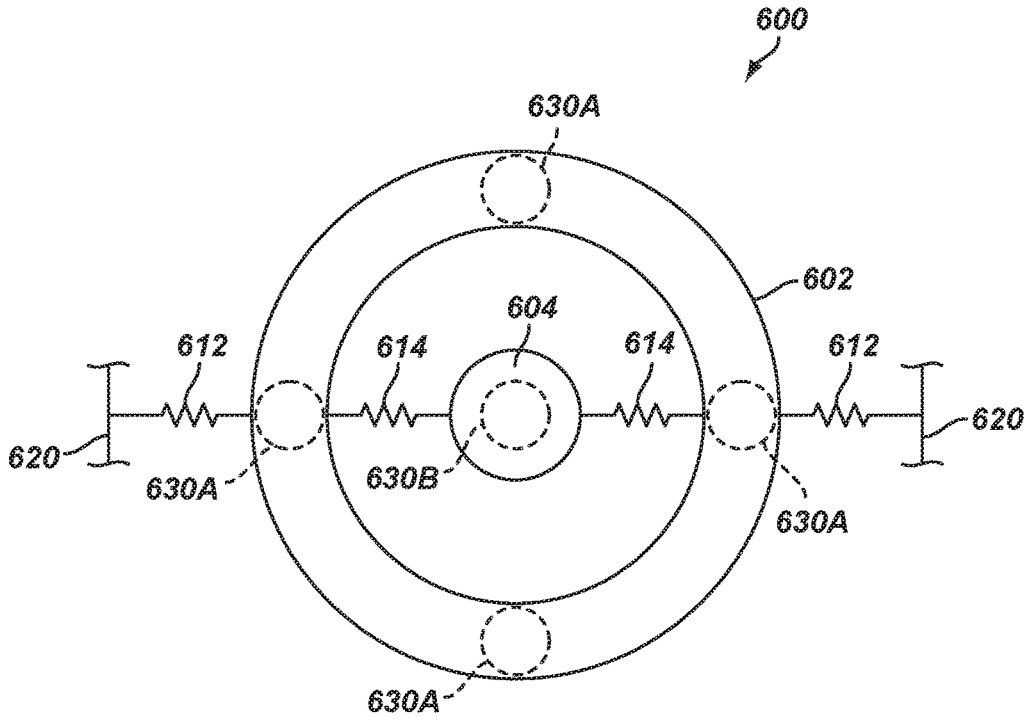
FIG. 6 is a simplified schematic diagram representing a top view of a tactile vibrator for a speaker according to an embodiment of the present disclosure.

FIG. 6 is a simplified schematic diagram representing a top view of a tactile vibrator 600 for a speaker assembly according to an embodiment of the present disclosure. The tactile vibrator 600 includes a first rigid member 602 and a second rigid member 604. The first rigid member 602 may be coupled to a support structure 620 via a first suspension member 612. The first rigid member 602 and the second rigid member 604 may be coupled together via a second suspension member 614. Thus, the tactile vibrator 600 of FIG. 6 may be configured as a dual spring/mass driver system.

In some embodiments, the rigid members 602, 604 may be generally circular and concentrically arranged with respect to each other. As a result, the first rigid member 602 (e.g., the outer rigid member) may be configured as an annular disk that has a greater radius than the second rigid member 604 (e.g., the center rigid member). In such a configuration, the suspension members 612, 614 may be attached to the edges of the respective rigid members 602, 604 to extend in a lateral direction such that the suspension members 612, 614 oscillate by bending up and down to generate the vibrations.

The first suspension member 612 and the second suspension member 614 are each shown symbolically in FIG. 6 as a spring rather than as a physical representation. Exemplary physical representations will be described below with reference to FIGS. 11 and 12. Referring still to FIG. 6, in some embodiments, the suspension members 612, 614 may be configured as flexible beams extending between respective rigid members 602, 604. Examples of such flexible beams are described in U.S. patent application Ser. No. 13/969,188, filed Aug. 18, 2013, now U.S. Pat. No. 8,965,028, issued Feb. 24, 2015, and entitled, "Speakers, Headphones, and Kits Related to Vibrations in an Audio System, and Methods for Forming Same," the disclosure of which is hereby incorporated herein by this reference in its entirety. Any number of beams is contemplated (e.g., two, three, four, etc.) depending on the desired flexibility and resonant frequency. The flexible beams may be evenly spaced apart, such as 180 degrees, 120 degrees, etc., depending on the number of flexible beams used. In some embodiments, one or more suspension members 612, 614 may be configured as a single structure (e.g., a diaphragm, a passive radiator) having an appropriate spring constant may also be used to couple the rigid members 602, 604 to each other, and to the support structure 620. In some embodiments, a combination of different types of suspension members may be used. For example, the first suspension member 612 may be configured as flexible beams while the second suspension member 614 may be configured as a single structure.

The tactile vibrator 600 may also include magnetic members 630A, 630B coupled to the rigid members 602, 604. For example, one or more magnetic members 630A may be coupled to the first rigid member 602, and one or more magnetic members 630B may be coupled to the second rigid member 604. In some embodiments, the second rigid member 604 (e.g., the center rigid member) may include a single magnetic member 630B, whereas the first rigid member 602 (e.g., the outer rigid member) may include a plurality of magnetic members 630A. The magnetic members associated with the same rigid member 602, 604 may be driven with the same signal. For example, each of the magnetic members 630A coupled to the first rigid member 602 may be driven with the same signal so that the same forces are applied to the first rigid member 602 at different locations.

While four magnetic members 630A are shown in FIG. 6 to be coupled to the first rigid member 602, it is contemplated that the first rigid member 602 (and other rigid members) may include any number of coils. As discussed above, the magnetic members 630A, 630B on the rigid members 602, 604 and magnets on a support structure (FIG. 5) may form coil/magnet pairs that are configured to cause displacement of the rigid members 602, 604 responsive to an audio signal. Thus, the magnetic members 630A, 630B may include coils and/or magnets depending on the particular configuration used to drive the tactile vibrator 600.

Each rigid member 602, 604 may be independently driven by the controller 404 (FIG. 4) to produce different vibration responses and resonant frequencies for the tactile vibrator 600. In other words, each of the rigid members 602, 604 may be driven by a different coil, which provides the capability for the rigid members 602, 604 to be driven by different frequencies. As a result, a different vibration response is achieved than would result with just one suspension member.

In operation, a changing magnetic field responsive to the audio signal received by the tactile vibrator 600 may cause corresponding oscillations in a corresponding suspension member 612, 614, which results in the corresponding magnetic members 630A, 630B and rigid members 602, 604 being displaced. The resulting vibrations may cause an increased tactile response (e.g., vibrations) that is experienced by the user. If the received audio signal is at the resonant frequency of the system, the tactile vibrator 600 may resonate, which may result in an increased tactile response at that resonant frequency. Because the tactile vibrator 600 is a multiple spring/mass driver system, the tactile vibrator 600 may have a plurality of different resonant frequencies depending on how the tactile vibrator 600 is driven.

Figure 7A:
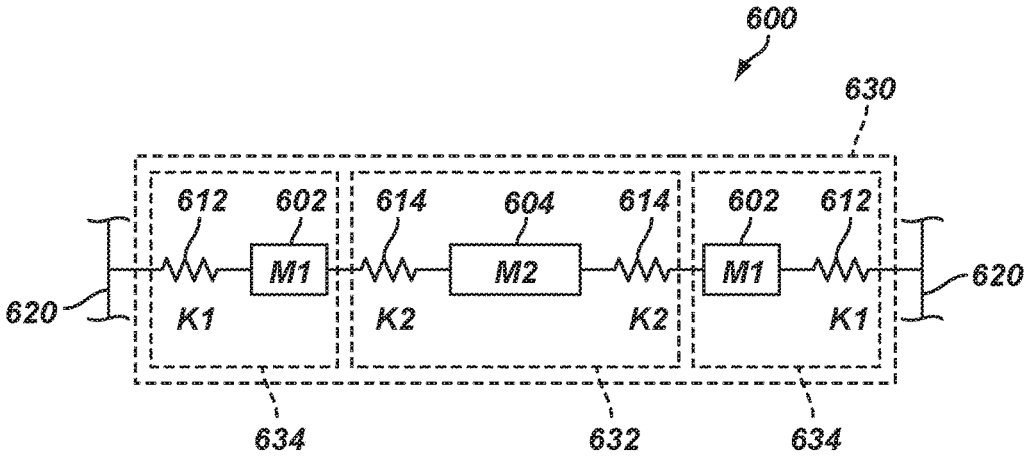
FIGS. 7A through 7D are cross-sectional side views of the tactile vibrator of FIG. 6 showing different vibration responses depending on how the different magnetic members are driven.

FIGS. 7A through 7D are cross-sectional side views of the tactile vibrator 600 of FIG. 6 showing different vibration responses depending on how the different magnetic members 630A, 630B are driven. As is shown in FIG. 7A, the tactile vibrator 600 includes multiple systems 630, 632, 634. In FIGS. 7A through 7D, "M" refers to the mass of the rigid member 602, 604 along with any magnetic members and/or additional added weight, and "K" refers to the spring constant of the suspension member 612, 614. The dashed lines outlining the systems 630, 632, 634 are shown in FIG. 7A, but the dashed lines and reference numerals are not shown in FIGS. 7B through 7D to simplify these figures even though the description thereof may refer to the different systems 630, 632, 634.

The first system 630 is defined as the entire combined system of all of the rigid members 602, 604 and the suspension members 612, 614. The second system 632 is defined as the sub-system of the second rigid member 604 and the second suspension member 614 alone without the effect of the first rigid member 602 and the first suspension member 612. The third system 634 is defined as the sub-system of the first rigid member 602 and the first suspension member 612 alone without the effect of the second rigid member 604 and the second suspension member 614. In some embodiments, mass M1 and mass M2 may be equal, while in other embodiments mass M1 and mass M2 may be different. Similarly, spring constant K1 and spring constant K2 may be the same or different depending on the particular embodiment. As the resonant frequency is dependent on the mass M and the spring constant K, the resonant frequencies for each individual system 630, 632, 634 may be different.

As discussed above, each rigid member 602, 604 may be independently driven to produce different vibration responses for the tactile vibrator 600 depending on how each rigid member 602, 604 is driven. For example, in some operational modes, the rigid members 602, 604 may be driven at the same frequency. In other modes, the rigid members 602, 604 may be driven at different frequencies. In some modes, one of the rigid members 602, 604 may be driven at a particular frequency, while the other rigid member 602, 604 may not be actively driven but may be in a passive mode.

Figure 7B:
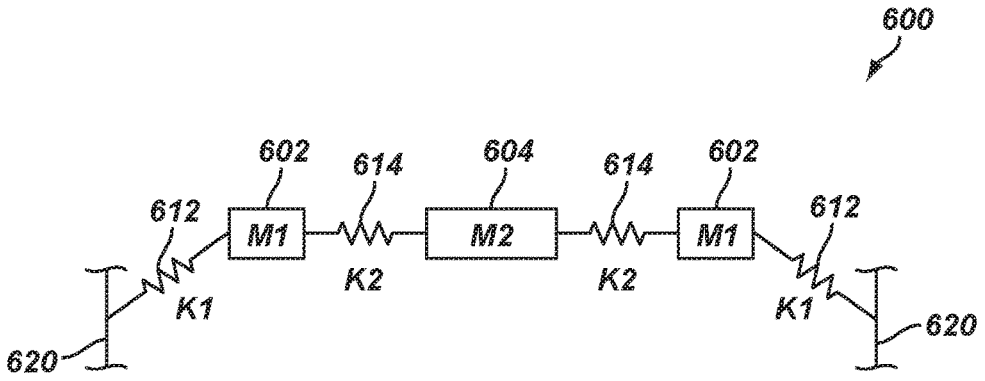

Referring specifically to FIG. 7B, each of the rigid members 602, 604 may be driven such that the rigid members 602, 604 move in relative unison together. For example, there may be a combination of resonant frequencies and driving frequencies for each of the rigid members 602, 604 such that the entire second system 632 behaves as if it is a rigid member, as the second suspension member 614 does not oscillate. Thus, the tactile vibrator 600 may be driven such that the rigid members 602, 604 and the second suspension member 614 are at least substantially stationary relative to each other, while the entire group is displaced responsive to the oscillations in the first suspension member 612.

One situation in which this may occur, is if the driving frequencies to the second system 632 are so far removed from the resonant frequency of the second system 632 that the components of the second system 632 do not move relative to each other. As an example, mass M2 may be relatively heavy compared to mass M1. As a result, the second system 632 may exhibit a relatively lower resonant frequency than the resonant frequency of the third system 634. If the driving frequency of both the rigid members 602, 604 is high such that the driving frequency is close to the resonant frequency of the third system 634 and far from the resonant frequency of the second system 632, the second system 632 may not oscillate and may move together with the third system 634. Thus, the resulting movement in the tactile vibrator 600 may be close to that of the first system 630 as if only one rigid member (having a combined mass of M1+M2) is moving. In addition, the first system 630 may exhibit a resonant frequency (based on M1+M2 and K1) that is different than the resonant frequencies of either of the second system 632 or the third system 634. Because the actual movement of the first system 630 may oscillate at a frequency that is different than the actual driving frequency of the coils associated with the rigid members 602, 604, the driving frequencies may be selected to achieve an actual movement that is near the resonant frequency of the first system 630.

Figure 7C:
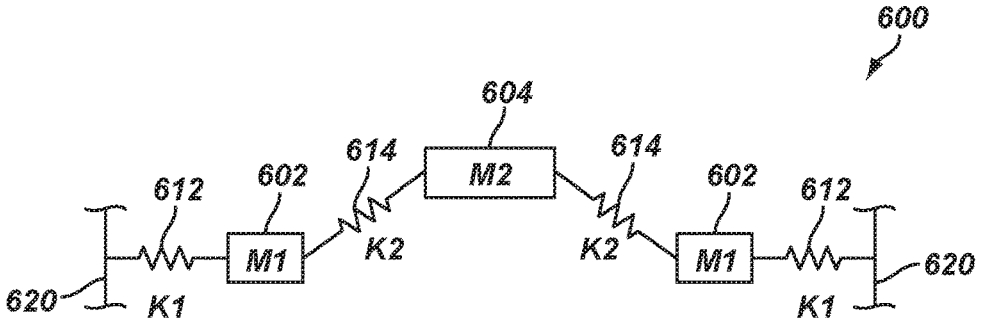

Referring now to FIG. 7C, the driving frequencies of the rigid members 602, 604 are close to the resonant frequency of the second system 632 and far from the resonant frequency of the third system 634. As a result, the third system 634 may not oscillate and the second system 632 may oscillate substantially independently. Thus, the resulting movement in the tactile vibrator 600 may be close to that of the second system 632 as if only one rigid member (having a mass of M2) is moving. In addition, the second system 632 may exhibit a resonant frequency (based on M2 and K2) that is different than the resonant frequencies of either the first system 630 or the third system 634. Thus, if vibrations having a frequency near the resonant frequency of the second system 632 are desired, the driving frequencies may be selected to achieve an actual movement that is near the resonant frequency of the second system 632.

Figure 7D:
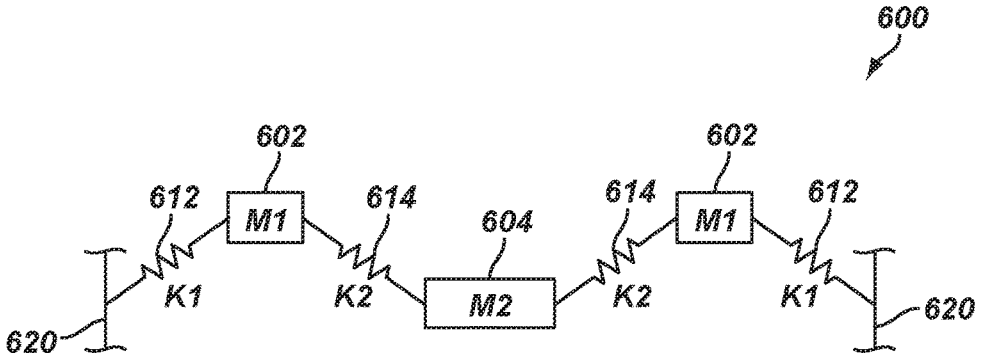

Referring now to FIG. 7D, the driving frequencies of the rigid members 602, 604 are a combination of frequencies that results in actual movement in the tactile vibrator 600, which may be close to that of the third system 634 as if only one rigid member (having a mass of M1) is moving. In addition, the third system 634 may exhibit a resonant frequency (based on M1, K1, and K2) that is different than the resonant frequencies of either of the first system 630 or the second system 632. Thus, if vibrations having a frequency near the resonant frequency of the third system 634 are desired, the driving frequencies used may achieve an actual movement that is near the resonant frequency of the third system 634.

Thus, the tactile vibrator 600 may have multiple resonant frequencies, and a plurality of vibration responses may result depending on the different combinations of driving frequencies used. In some embodiments, the controller 404 (FIG. 4) may be configured to analyze the audio signal 401 (FIG. 4) received from the media player 306 (FIG. 3) and generate the driving frequencies to each rigid member to create the overall vibration effect that is desired. The controller 404 may have the different masses and spring constants stored in memory so that the controller 404 may calculate the driving frequencies for the second audio signal 405 (FIG. 4) that is transmitted to the tactile vibrator 600. The second audio signal 405 may be divided into separate channels that are connected to the different rigid members 602, 604, which may permit the different rigid members 602, 604 to be driven independently at different frequencies. In some embodiments, the analysis of the audio signal 401 may be performed during the operation such that the vibration response of the tactile vibrator 600 may be adjusted dynamically to tune the tactile vibrator 600 and generate a custom complex response by driving each rigid member 602, 604 differently.

As a result, different vibration sensations may be generated with different audio signals. In addition, vibrations may be generated along a broader range of frequencies in comparison to a conventional tactile vibrator that typically can only provide vibrations in the bass frequency range. Instead, tactile vibrations may also be generated for midrange frequencies, upper midrange frequencies, and/or high end frequencies depending on the combination of driving frequencies and physical characteristics (masses, spring constants, etc.) of the components of the tactile vibrator 600. Such vibration frequencies may be desirable for different types of media content, such as music, movies, television, gaming, etc. For example, in a gaming application, it may be desirable to have different vibration profiles at different times. The controller 404 may generate a low frequency vibration response to accompany an explosion, and a higher frequency vibration response to accompany a gunshot.

Figure 8:
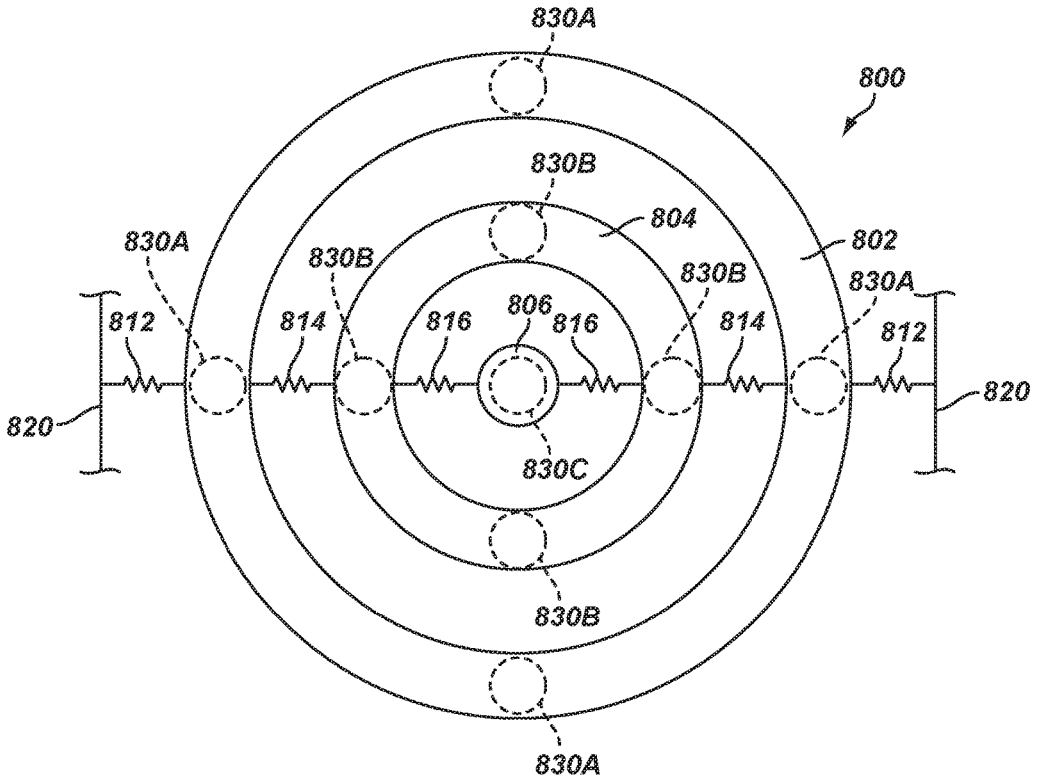
FIG. 8 is a simplified schematic diagram representing a top view of a tactile vibrator according to an embodiment of the present disclosure.
Figure 9:
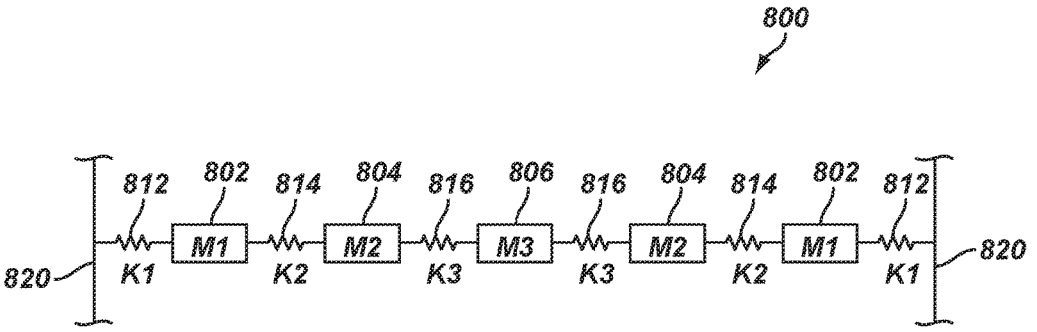
FIG. 9 is a cross-sectional side view of the tactile vibrator of FIG. 8.

FIG. 8 is a simplified schematic diagram representing a top view of a tactile vibrator 800 according to an embodiment of the present disclosure. FIG. 9 is a cross-sectional side view of the tactile vibrator 800 of FIG. 8. The tactile vibrator 800 includes a first rigid member 802, a second rigid member 804, and a third rigid member 806. The first rigid member 802 may be coupled to a support structure 820 via a first suspension member 812. The first rigid member 802 and the second rigid member 804 may be coupled together via a second suspension member 814. The second rigid member 804 and the third rigid member 806 may be coupled together via a third suspension member 816. Thus, the tactile vibrator 800 of FIG. 8 may be configured as a triple spring/mass driver system. In this embodiment, the third rigid member 806 may be the center of the tactile vibrator 800, and the second rigid member 804 and the first rigid member 802 may be annular disks of different diameters that are concentric with the third rigid member 806. In some embodiments, one or more rigid members 802, 804, 806 may be arranged in a stacked configuration. For example, the tactile vibrator 800 may include a first rigid member/flexible beam pair in a first plane that is coupled with a second rigid member/flexible beam pair in a second plane. In some embodiments, one or more planes may have different types of configurations, such as a diaphragm or a passive radiator. Different combinations of each configuration are also contemplated.

The tactile vibrator 800 may also include magnetic members 830A, 830B, 830C that are associated with each rigid member 802, 804, 806, respectively. The magnetic members 830A, 830B, 830C may be independently driven by the controller 404 (FIG. 4) as discussed above. Thus, the tactile vibrator 800 may be operated in a similar manner to the tactile vibrator 600 of FIG. 6, with the exception of additional resonant frequencies and complexity to the different vibration responses that may be exhibited by the tactile vibrator 800 because of the additional sub-systems created by the addition of another level of rigid members/suspension members.

It is also contemplated that embodiments of the present disclosure include multi-resonant systems having more than three spring/mass systems. Thus, additional levels of rigid members and suspension members are also contemplated as additional embodiments of the present disclosure. Thus, embodiments of the present disclosure may include a coil/magnet assembly associated with each rigid member in the tactile vibrator. By including more resonant frequencies and additional options for vibration responses, embodiments of the present disclosure may have a greater frequency range of operation. In addition, having more resonant frequencies permits the tactile vibrators to operate closer to a resonant frequency, which may improve efficiency of the system. An improved efficiency may require less power and/or a smaller amplifier (or no amplifier), which may reduce costs and/or size of the headphone.

Figure 10:
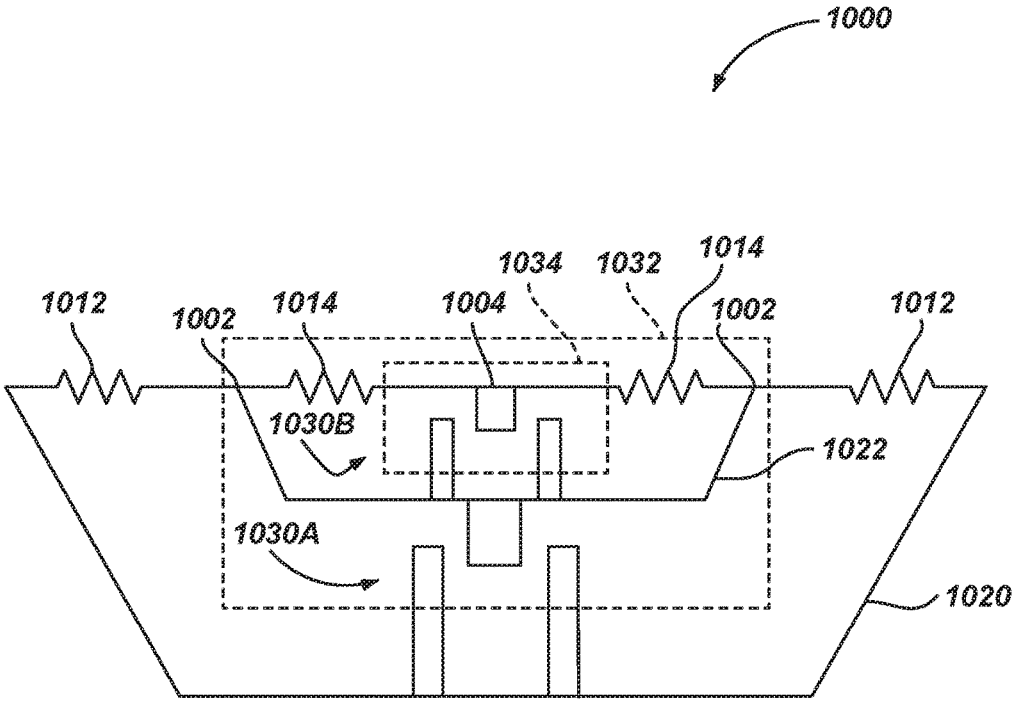
FIG. 10 is a simplified schematic diagram representing a cross-sectional side view of a tactile vibrator for a speaker assembly according to another embodiment of the present disclosure.

FIG. 10 is a simplified schematic diagram representing a cross-sectional side view of a tactile vibrator 1000 for a speaker assembly according to another embodiment of the present disclosure. In this embodiment, the tactile vibrator 1000 may include a plurality of rigid members 1002, 1004 and a plurality of suspension members 1012, 1014. The first suspension member 1012 may be coupled to a first support structure 1020. The first rigid member 1002 may be coupled to a second support structure 1022. As a result, two mass/spring systems 1032, 1034 may be created. The first mass/spring system 1032 may encompass the second mass/spring system 1034. The magnetic members 1030A, 1030B may be coupled differently than in the other embodiments described above. For example, the magnetic members 1030A for the first mass/spring system 1032 may be coupled to the first support structure 1020 and the second support structure 1022. For example, coils may be coupled to the first support structure 1020 and a magnet may be coupled to the second support structure 1022, or vice versa. The magnetic members 1030B for the second mass/spring system 1034 may be coupled to the second rigid member 1004 and the second support structure 1022. For example, a magnet may be coupled to the second rigid member 1004 and coils may be coupled to the second support structure 1022, or vice versa. The magnetic members 1030A, 1030B may be driven independently at different frequencies to generate different vibration responses as discussed above. Because the second support structure 1022 is coupled to the first rigid member 1002, the two elements will be displaced together.

Figure 11:
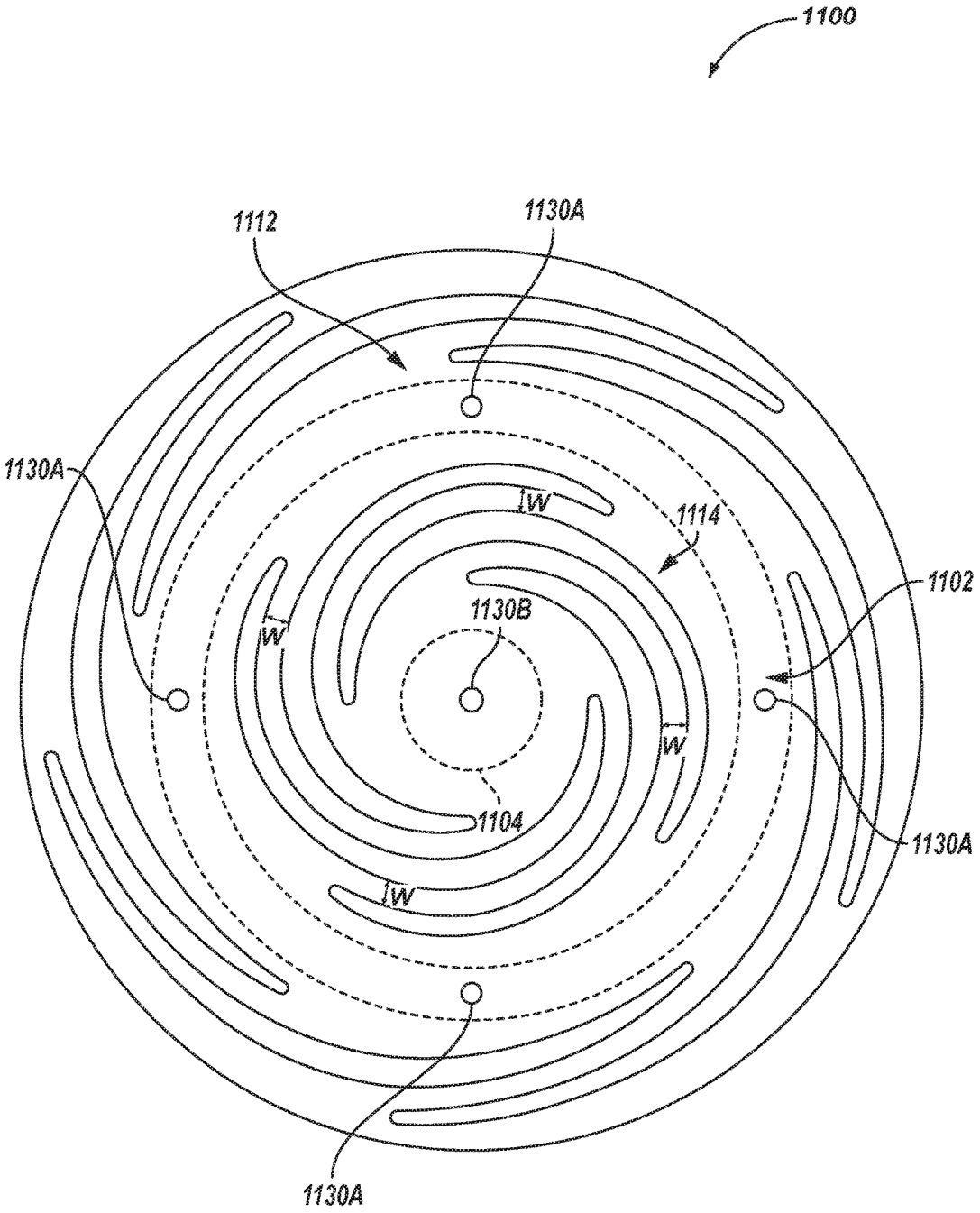
FIG. 11 is a top view of an embodiment of a tactile vibrator according to an embodiment of the present disclosure.

FIG. 11 is a top view of an embodiment of a tactile vibrator 1100 according to an embodiment of the present disclosure. The tactile vibrator 1100 includes a plurality of rigid members 1102, 1104, and a plurality of suspension members 1112, 1114. The first rigid member 1102 is defined as the area between the corresponding dashed circles, and the second rigid member 1104 is defined as the area within the middle dashed circle. The suspension members 1112, 1114 are defined as the areas outside of those rigid members 1102, 1104. The rigid members 1102, 1104 may include magnetic members 1130A, 1130B, coupled thereto.

The tactile vibrator 1100 may be configured as a single piece of material (e.g., stamped metal), such that the suspension members 1112, 1114 and the rigid members 1102, 1104 may be integrally formed. The suspension members 1112, 1114 may be configured with flexible beams separated by apertures that enable the suspension members 1112, 1114 to be deformed (i.e., tilt) relative to the resting plane during operation of the tactile vibrator 1100. The rigid members 1102, 1104 may be solid regions that remain parallel to the resting plane while being displaced during operation of the tactile vibrator 1100.

Figure 12:
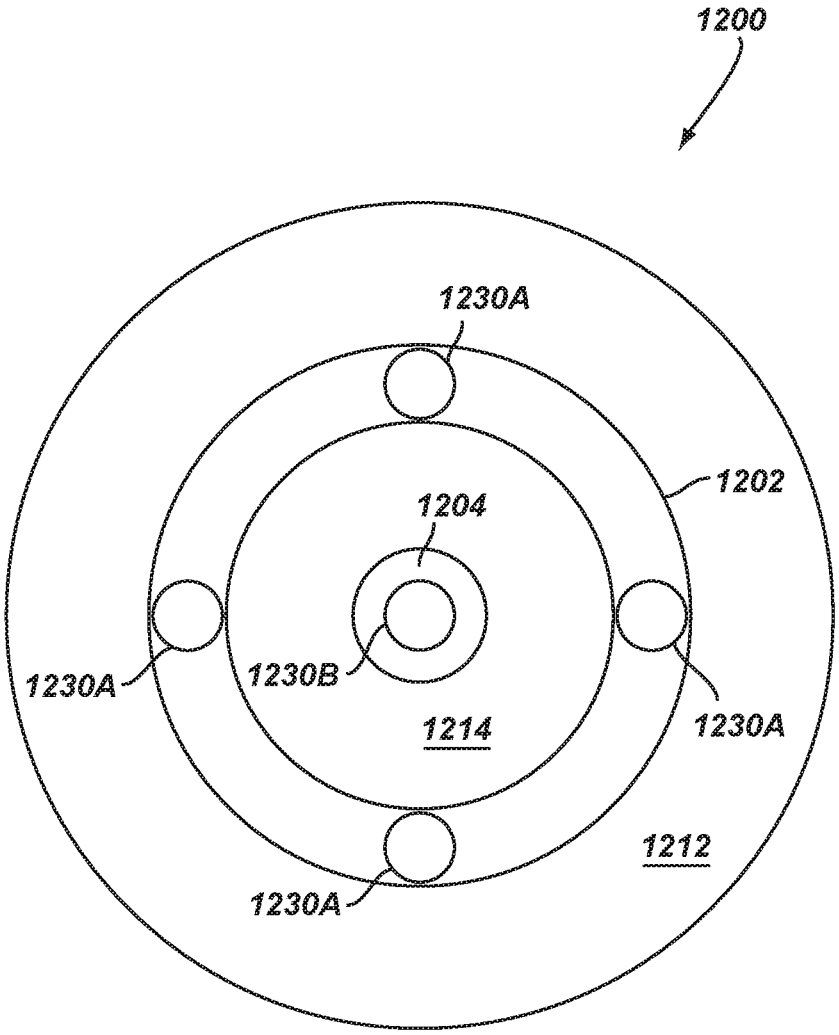
FIG. 12 is a top view of another embodiment of a tactile vibrator according to an embodiment of the present disclosure.

FIG. 12 is a top view of an embodiment of a tactile vibrator 1200 according to an embodiment of the present disclosure. The tactile vibrator 1200 includes a plurality of rigid members 1202, 1204, and a plurality of suspension members 1212, 1214. The rigid members 1202, 1204 may include magnetic members 1230A, 1230B, coupled thereto.

The tactile vibrator 1200 may be configured as multiple elements, such that the suspension members 1212, 1214 and the rigid members 1202, 1204 may be not be integrally formed (e.g., may be separate materials). The suspension members 1212, 1214 may be formed from a flexible material (e.g., silicon speaker surround material) that enables the suspension members 1212, 1214 to be deformed (i.e., tilt) relative to the resting plane during operation of the tactile vibrator 1200. The rigid members 1202, 1204 may be formed from a more rigid material (e.g., a solid metal structure, a solid plastic structure, etc.) that remains parallel to the resting plane while being displaced during operation of the tactile vibrator 1200.

In some embodiments, a tactile vibrator may include a combination of suspension members that are formed with beams (e.g., FIG. 11) and a solid structure (e.g., FIG. 12). In other words, it is contemplated that a single tactile vibrator may include at least one suspension member formed as flexible beams (e.g., stamped metal), and at least one additional suspension member formed as a flexible material (e.g., silicon speaker surround material).

Additional non-limiting embodiments are described below.

Embodiment 1: A speaker assembly, comprising: a support structure; and a tactile vibrator coupled to the support structure, the tactile vibrator including a plurality of rigid members coupled to a plurality of suspension members, wherein each rigid member of the plurality of rigid members has at least one magnetic member coupled thereto for generating tactile vibrations during operation of the speaker assembly.

Embodiment 2: The speaker assembly of Embodiment 1, wherein the rigid members of the plurality of rigid members are arranged in a stacked configuration.

Embodiment 3: The speaker assembly of Embodiment 1, wherein the rigid members of the plurality of rigid members are arranged in a concentric configuration.

Embodiment 4: The speaker assembly of Embodiment 1, wherein the plurality of rigid members and the plurality of suspension members form a plurality of individual mass/spring systems that exhibit a different resonant frequency.

Embodiment 5: The speaker assembly of Embodiment 1, wherein at least one rigid member of the plurality of rigid members has a plurality of magnetic members coupled thereto.

Embodiment 6: The speaker assembly of Embodiment 1, wherein the at least one magnetic member coupled with a first rigid member and the at least one magnetic member coupled with a second rigid member are configured to be driven independently from each other.

Embodiment 7: The speaker assembly of Embodiment 6, further comprising a controller having a first channel that drives the at least one magnetic member of the first rigid member, and a second channel that drives the at least one magnetic member of the second rigid member.

Embodiment 8: The speaker assembly of Embodiment 1, wherein the at least one magnetic member includes a coil coupled to the respective rigid member, and a magnet coupled to the support structure.

Embodiment 9: The speaker assembly of Embodiment 1, wherein the at least one magnetic member includes a magnet coupled to the respective rigid member, and a coil coupled to the support structure.

Embodiment 10: The speaker assembly of Embodiment 1, wherein the tactile vibrator further includes an additional suspension member coupled to an additional rigid member that is passively driven without a magnetic member coupled thereto.

Embodiment 11: A headphone including at least one speaker assembly and a device for operatively coupling the at least one speaker assembly with a media player configured to send an electrical audio signal to the at least one speaker assembly, the at least one speaker assembly comprising: a support structure; and a tactile vibrator coupled to the support structure, the tactile vibrator including: a first rigid member coupled to the support structure via a first support member; a second rigid member coupled to the first rigid member via a second support member; at least one magnetic member coupled to the first rigid member; and at least one magnetic member coupled to the second rigid member, wherein the at least one magnetic members of the first rigid member and the second rigid member are configured to be displaced within the support structure and generate tactile vibrations responsive to receipt of the electrical audio signal.

Embodiment 12: The headphone of Embodiment 11, further comprising a headband, the at least one speaker assembly attached to the headband.

Embodiment 13: The headphone of Embodiment 11, wherein the at least one speaker assembly comprises an earbud speaker assembly configured to fit within an ear of a person using the headphone.

Embodiment 14: The headphone of Embodiment 11, wherein the at least one speaker assembly further comprises: a housing; and a cushion attached to the housing and configured to be disposed on or over an ear of a person using the headphone.

Embodiment 15: The headphone of Embodiment 11, wherein the tactile vibrator further includes: a third rigid member coupled to the second rigid member via a third support member; and at least one magnetic member coupled to the third rigid member.

Embodiment 16: The headphone of Embodiment 11, further comprising a controller configured to drive coils associated with the at least one magnetic members of the first rigid member, the second rigid member, and the third rigid member according to different operational modes.

Embodiment 17: The headphone of Embodiment 16, wherein the different operational modes result in a plurality of different resonant frequencies for the tactile vibrator.

Embodiment 18: The headphone of Embodiment 17, wherein the different resonant frequencies are dependent on a combination of different drive frequencies for the at least one magnetic members of the first rigid member, the second rigid member, and the third rigid member.

Embodiment 19: The headphone of Embodiment 11, wherein at least two of the first rigid member, the second rigid member, and the third rigid member have different masses.

Embodiment 20: The headphone of Embodiment 11, wherein at least two of the first suspension member, the second suspension member, and the third suspension member have different spring constants.

Embodiment 21: A method of operating a speaker assembly, the method comprising: driving a tactile vibrator having a plurality of magnetic members coupled to a plurality of rigid members and a plurality of suspension members to cause tactile vibrations in the speaker assembly.

Embodiment 22: The method of Embodiment 21, wherein driving the tactile vibrator during a first mode includes: driving a first magnetic member coupled to a first rigid member with a first driving frequency; and driving a second magnetic member coupled to a second rigid member with a second driving frequency different than the first driving frequency.

Embodiment 23: The method of Embodiment 22, wherein driving the tactile vibrator during a second mode includes: actively driving the first magnetic member while allowing the second magnetic member to remain passive.

Embodiment 24: The method of Embodiment 21, wherein the tactile vibrations exhibit a frequency that is different than a driving frequency associated with at least one rigid member.

Embodiment 25: The method of Embodiment 24, wherein the frequency of the tactile vibrations is a bass frequency.

Embodiment 26: The method of Embodiment 24, wherein the frequency of the tactile vibrations is one of a midrange frequency and an upper midrange frequency.

Embodiment 27: The method of Embodiment 24, wherein the frequency of the tactile vibrations is a high end frequency.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventors.

What is claimed is:

1. A headphone, comprising:

a first speaker assembly for a first ear of a user; and a second speaker assembly for a second ear of the user, wherein each speaker assembly includes:

a support structure;

an audio driver coupled to the support structure and configured to convert an audio signal to audible sound; and a tactile vibrator configured as a multiple spring/mass driver system, the tactile vibrator coupled to the support structure and including:

a first rigid member including a first magnetic member coupled thereto;

a second rigid member including a second magnetic member coupled thereto;

a first suspension member coupled between the first rigid member and the support structure; and a second suspension member coupled between the first rigid member and the second rigid member; and at least one controller configured to generate at least one signal for driving the first magnetic member and the second magnetic member at the same time during operation of the respective speaker assembly to have a combined effect that generates tactile vibrations with the first rigid member and the second rigid member responsive to analyzing the audio signal.

2. The headphone of claim 1, wherein the first rigid member further includes a plurality of additional magnetic members coupled thereto.

3. The headphone of claim 2, wherein the at least one signal is a single signal driving the plurality of additional magnetic members and the first magnetic member such substantially the same force is applied to the first rigid member at a location of each magnetic member when driving the plurality of magnetic members.

4. The headphone of claim 1, wherein the at least one controller is configured to independently drive the first magnetic member coupled to the first rigid member and the second magnetic member coupled to the second rigid member at different frequencies at the same time during operation of the speaker.

5. The headphone of claim 1, wherein the at least one controller is configured to operate according to different operational modes that produce different vibration responses for the tactile vibrator, and wherein operational modes include an operational mode during which the controller drives the first rigid-magnetic member and the magnetic rigid member at different frequencies at the same time during operation of the speaker.

6. The headphone of claim 1, wherein the at least one controller is configured to operate according to different operational modes that produce different vibration responses for the tactile vibrator, and wherein operational modes include an operational mode during which the at least one controller drives the first magnetic member and the second magnetic member at a same frequency at the same time during operation of the speaker.

7. The headphone of claim 1, wherein the at least one controller is configured to operate according to different operational modes that produce different vibration responses for the tactile vibrator, and wherein operational modes include an operational mode during which the at least one controller drives one of the first magnetic member or the second magnetic member at a first frequency while not driving the other of the first rigid member of the second rigid member to vibrate in a passive manner.

8. The headphone of claim 1, wherein the at least one controller is configured to generate the at least one signal for driving the first magnetic member coupled to the first rigid member and the second magnetic member coupled to the second rigid member at the same time to create the combined effect of tactile vibrations at bass frequencies during a first operational mode, tactile vibrations at midrange frequencies during a second operational mode, tactile vibrations at upper midrange frequencies during a third operational mode, tactile vibrations at high end frequencies during a fourth operational mode.

9. The headphone of claim 1, wherein the first suspension member includes a plurality of distinct beams that are spaced apart from each other and extend between the first rigid member and the support structure.

10. The headphone of claim 1, wherein the first suspension member includes a single structure extending between the first rigid member and the support structure.

11. The headphone of claim 1, wherein the single structure is one of a passive radiator structure, a diaphragm structure, or a speaker surround material.

12. The headphone of claim 1, further comprising a third rigid member and a third suspension member coupled between the second rigid member and the third rigid member, wherein the second rigid member is annular and concentric to the third rigid member.

13. The headphone of claim 1, wherein each of the first speaker assembly and the second speaker assembly further includes another tactile vibrator coupled to the support structure in a stacked configuration in a plane parallel with the tactile vibrator.

14. The headphone of claim 1, wherein the at least one controller is configured to analyze the audio signal to calculate driving frequencies for each of the first magnetic member and the second magnetic member that cause actual movement of the first rigid member at about a resonant frequency for a combined mass-spring system including the first rigid member and the second rigid member.

15. The headphone of claim 14, wherein the at least one controller includes memory having stored thereon masses for each of the first rigid member and the second rigid member, and spring constants for each of the first suspension member and the second suspension member used to calculate the driving frequencies.

16. The headphone of claim 1, wherein the at least one controller is configured to dynamically tune a vibration response for each respective tactile vibrator by selecting different driving frequencies for each of the first magnetic member and the second magnetic member responsive to analyzing the audio signal.

17. A method of operating a headphone including a first speaker assembly for a first ear of a user and a second speaker assembly for a second ear of the user, the method comprising:

driving a first audio driver positioned within the first speaker assembly causing audible sound waves to be produced responsive to an input audio signal;

driving a second audio driver positioned within the second speaker assembly causing audible sound waves to be produced responsive to the input audio signal;

driving a first tactile vibrator positioned within the first speaker assembly to cause tactile vibrations in the second speaker assembly; and driving a second tactile vibrator positioned within the second speaker assembly to cause tactile vibrations in the second speaker assembly, wherein each of the first and second tactile vibrators include:

a first rigid member including a first magnetic member coupled thereto;

a second rigid member including a first magnetic member coupled thereto;

a first suspension member coupled between the first rigid member and the support structure; and a second suspension member coupled between the first rigid member and the second rigid member, wherein driving the first tactile vibrator and the second tactile vibrator include driving the first magnetic member and the second magnetic member of each respective tactile vibrator at the same time to create a combined effect for causing tactile vibrations responsive to analyzing the input audio signal.

18. The method of claim 17, wherein driving each of the first tactile vibrator and the second tactile vibrator at the same time is performed during an operational mode of a controller including:

driving each respective first magnetic member with a first driving frequency; and driving each respective second magnetic member with a second driving frequency different than the first driving frequency.

19. The method of claim 17, wherein driving each of the first tactile vibrator and the second tactile vibrator at the same time is performed during an operational mode of a controller including driving each respective first magnetic member and each respective second magnetic member to move in unison together relative to a resting plane.

20. The method of claim 17, wherein driving each of the first tactile vibrator and the second tactile vibrator at the same time is performed during an operational mode of a controller including driving each respective first magnetic member and each respective second magnetic member to move in directions opposite each other relative to a resting plane.

* * * * *